US006880319B2

(12) United States Patent
Zhu

(10) Patent No.: US 6,880,319 B2
(45) Date of Patent: Apr. 19, 2005

(54) CUT RESISTANT YARNS AND PROCESS FOR MAKING THE SAME, FABRIC AND GLOVE

(75) Inventor: Reiyao Zhu, Midlothian, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 117 days.

(21) Appl. No.: 10/696,091

(22) Filed: Oct. 29, 2003

(65) Prior Publication Data

US 2004/0088963 A1 May 13, 2004

Related U.S. Application Data

(62) Division of application No. 09/933,694, filed on Aug. 21, 2001, now Pat. No. 6,694,719.

(51) Int. Cl.[7] ..... D02G 3/32
(52) U.S. Cl. ..... 57/3; 57/350; 28/271
(58) Field of Search ..... 57/3, 6, 210, 225–227, 57/245, 246, 333, 350; 28/247, 254, 271, 274

(56) References Cited

U.S. PATENT DOCUMENTS

| | | | |
|---|---|---|---|
| 3,543,358 | A | 12/1970 | Breen et al. |
| 3,991,551 | A | 11/1976 | Petree |
| 4,742,578 | A | 5/1988 | Seid |
| 4,873,998 | A | 10/1989 | Joyner |
| 4,942,626 | A | 7/1990 | Stern et al. |
| 5,231,700 | A | 8/1993 | Cutshall |
| 5,442,815 | A | 8/1995 | Cordova et al. |
| 5,568,657 | A | 10/1996 | Cordova et al. |
| 6,044,493 | A | 4/2000 | Post |
| 6,155,084 | A | 12/2000 | Andrews et al. |

*Primary Examiner*—John J. Calvert
*Assistant Examiner*—Shaun R Hurley

(57) ABSTRACT

The present invention relates to cut resistant yarns. More particularly, it relates to a process of making a cut resistant yarn comprising a plurality of cut resistant filaments and at least one elastomeric filament, as well as fabrics and articles such as gloves, comprising such cut resistant yarns.

3 Claims, 1 Drawing Sheet

CUT RESISTANT YARNS AND PROCESS FOR MAKING THE SAME, FABRIC AND GLOVE

CROSS REFERENCE TO RELATED APPLICATIONS

This is a divisional application of U.S. patent application Ser. No. 09/933,694 filed Aug. 21, 2001, now U.S. Pat. No. 6,694,719 patented Feb. 24, 2004.

FIELD OF THE INVENTION

The present invention relates to cut resistant yarns. More particularly, it relates to a cut resistant yarn comprising a plurality of cut resistant filaments and at least one elastomeric filament, as well as fabrics and articles such as gloves, comprising such cut resistant yarns. The present invention has many applications, including use in the aerospace industry and other industries where an assembly line or cutting machinery is utilized.

BACKGROUND OF THE INVENTION

Generally, protective gloves are well known in the art. In many industries such gloves are necessary in order to afford persons protection from cuts and lacerations. Typically, the gloves are comprised of separate discrete layers as described in U.S. Pat. No. 6,044,493 (Post), U.S. Pat. No. 4,942,626 (Stern et al.) and U.S. Pat. No. 4,742,578 (Seid), or a combination of hard molded materials covering selected regions of the hand where latex surgical gloves may be worn over or under the hardened mold material as described in U.S. Pat. No. 4,873,998 (Joyner).

Further, gloves are also typically knitted or woven from yarns having a core and wrapping configuration wherein puncture resistance is increased by the attachment of leathers, leather-like materials, natural elastomers or pliant metals to selected areas of the exterior of the glove, as described in U.S. Pat. No. 5,231,700 (Cutshall).

The present invention provides the advantage of cut resistance and tactile sensitivities while having the components that impart such qualities integrated with one another throughout the fabric, glove or yarn.

BRIEF SUMMARY OF THE INVENTION

The present invention relates to a process of making a cut resistant yarn comprising at least one continuous synthetic elastomeric filament and a plurality of bulked continuous cut resistant filaments comprising the steps of:

(a) combining at least one continuous synthetic elastomeric filament under tension and a plurality of continuous cut resistant filaments, to form a commingled yarn where the elastomeric filament(s) is under tension;

(b) overfeeding the commingled yarn to a fluid-jet at a rate of no more than 30% per unit length of the yarn; and (c) bulking the plurality of continuous cut resistant filaments in the yarn with a fluid to create a random entangled loop structure in the yarn.

Still further, the present invention relates to a process for making a glove comprising the steps of:

(a) knitting or weaving a glove from a cut resistant yarn having strength and recovery capabilities comprising at least one continuous synthetic elastomeric filament and a plurality of bulked continuous cut resistant filaments;

(b) heat setting the elastomeric filament(s) of the glove;

(c) coating the glove; and (d) curing the coating disposed on the glove.

DETAILED DESCRIPTION OF THE INVENTION

Figure 1:
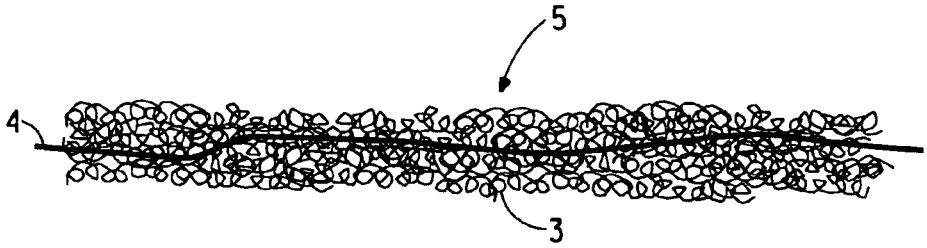
FIG. 1 depicts a lateral view of a cut resistant yarn of the present invention.
Figure 2:
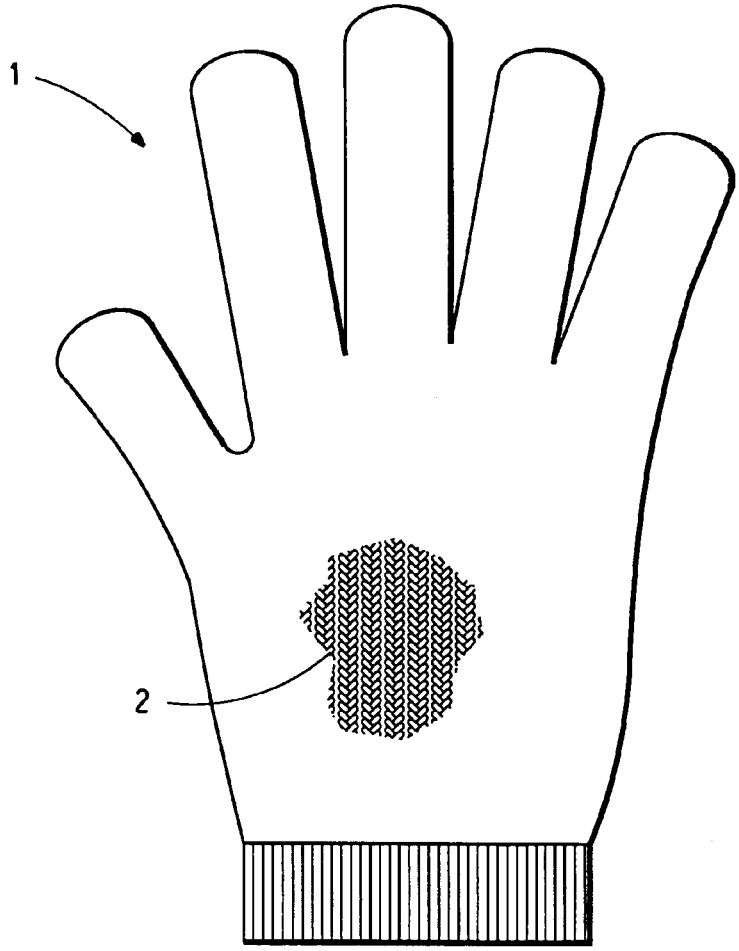
FIG. 2 depicts a top view of a glove and a fabric of the present invention.

The first necessary component of the present invention is at least one continuous synthetic elastomeric filament (4). The continuous synthetic elastomeric filament(s) (4) is typically in the range of about 20 denier to about 200 denier, however a denier of about 100 to about 150 is preferred.

Suitable examples of the continuous synthetic elastomeric filament(s) (4) include, but are not limited to, polyurethane filament and rubber and combinations thereof. The most preferred continuous synthetic elastomeric filament (4) is spandex.

As used herein, "elastomeric", shall refer to a filament that has, at least to a degree, the properties of stretch and recovery, wherein "stretch" indicates an ability to increase in length in the direction of the filament's axis, and "recovery" indicates an ability of a filament to substantially return to its original shape after an amount of tension has been exerted on the filament.

As used herein, "spandex" shall refer to a manufactured filament in which the filament-forming substance is a long chain synthetic polymer comprised of at least about 85% by weight of a segmented polyurethane.

A second necessary component of the present invention is a plurality of bulked continuous cut resistant filaments (3). Prior to bulking, the continuous cut resistant filaments are typically provided in a yarn in the range of about 50 denier to about 2000 denier, and a preferred range of about 200–600 denier. Further these continuous cut resistant filaments typically have a denier per filament of less than about 3.0, however, the range of about 0.85 denier to about 2.0 denier per filament is preferred.

After bulking, the denier of a continuous cut resistant yarn, particularly an aramid yarn, generally increases proportionally to the utilized overfeed where the bulked yarn shows an increase in its weight per unit length in the range of about 3% to about 25%. Therefore, the bulked yarn containing the synthetic elastomeric filament(s) (4) and the bulked continuous cut resistant filaments (3) is in the range of about 70 to about 2800 denier, however a denier of about 200 to about 800 is preferred.

The cut resistant filaments (3) useful in this invention are made from a variety of high-strength fiber forming polymers. Suitable examples of cut resistant filaments (3) include, but are not limited to, aromatic polyamide, polyolefin, high molecular weight polyethylene, high molecular weight polyvinyl alcohol, high molecular weight polyacrylonitrile, liquid crystal polyester and combinations thereof, however aramid filaments are preferred. The term "high strength", refers to a tenacity of at least about 10 grams/denier, however a tenacity of at least about 18 grams/denier is preferred. The term "high molecular weight", when used in reference to polyvinyl alcohol, refers to a molecular weight of at least about 200,000. However, "high molecular weight", when used in reference to polyacrylonitrile, refers to a molecular weight of at least about 400,000, and when used in reference to polyethylene, it refers to a molecular weight of at least about 150,000. Particular examples of cut resistant filaments include polybenzoxazole (PBO), polyvinyl alcohol (PVA), HDPE (Spectra®, manufactured by the Honeywell Corporation), HDPE (Dyneema®, manufactured by DSM Incorporated) and Technora® (manufactured by the Teijin Corporation).

The present invention relates to a cut resistant yarn (5) comprising a plurality of bulked continuous cut resistant filaments (3) and at least one continuous synthetic elastomeric filament (4) where the plurality of bulked continuous cut resistant filaments (3) have a random entangled loop structure in the yarn. This combination provides for the formation of an elastic yarn having properties allowing it to be highly stretchable.

Typically, the present invention comprises at most about 30% of continuous synthetic elastomeric filament(s) (4), however a range of about 3% to about 10% is preferred. Similarly, the present invention comprises at least about 70% of the plurality of bulked continuous filaments (3), however a range of about 90% to about 97% is preferred. Additionally, the cut resistant yarn (5) may further include other components, for example, nylon, polyester or other typical textile fibers.

Another embodiment of the present invention relates to a fabric (2) comprising the cut resistant yarn (5) of the present invention. The fabric (2) may be arranged in any configuration and may additionally include other components such as nylon, polyester or other typical textile fibers.

Further, the fabric (2) typically has a thickness of about 1–7 millimeters (about 0.04–0.28 inches), preferably a thickness of about 2–4 millimeters (about 0.08–0.16 inches) and weighs about 3 oz/yd$^2$ to about 20 oz/yd$^2$ (about 0.1 kg/m$^2$ to about 0.7 kg/m$^2$), however about 8 oz/yd$^2$ to about 14 oz/yd$^2$ (about 0.3 kg/m$^2$ to about 0.5 kg/m$^2$) is preferred. The fabric (2) of the present invention is preferably woven or knitted however any configuration may be used. The fabric (2) of the present invention can be made or constructed into various garments or articles such as gloves, sleeves, aprons, pants, shirts or other objects where a high level of cut resistance and stretch ability is required, however gloves are preferred.

Optionally, a coating may be applied to either the fabric (2) or the glove (1) comprising the cut resistant yarn (5), wherein the preferred polymer coating is either a polyurethane or a polynitrile. The polymer coating allows for the retention of tactile properties as well as improved gripping ability and a high level of dexterity. Generally, the coating of the present invention has a thickness of about 0.2 millimeters (about 0.008 inches) to about 5 millimeters (0.2 inches), however a thickness of about 0.5 millimeters (about 0.02 inches) to about 2 millimeters (about 0.08 inches) is preferred. The coating may be applied via any conventional method known in the art, for example, dipping.

Another embodiment of the present invention relates to a process of making a cut resistant yarn (5) comprising the steps of:

a.) combining at least one continuous synthetic elastomeric filament under tension and a plurality of continuous cut resistant filaments to form a commingled yarn where the elastomeric filament(s) is under tension;

b.) overfeeding the commingled yarn to a fluid-jet at a rate of no more than 30% per unit length of the yarn; and c.) bulking of the plurality of continuous cut resistant filaments in the commingled yarn with a fluid to create a random loop structure in the yarn.

One method of making the cut resistant yarn (5) of the present invention includes a fluid-jet, preferably an air-jet, texturing process as described in U.S. Pat. No. 3,543,358 (A. L. Breen et al.). The yarn (5) of the present invention is made by bulking a commingled yarn to create a random entangled loop structure in the yarn. In such processes one or more filament yarns are subjected to a fluid-jet that blows individual filaments into a number of loops per inch, both on the surface and in the yarn bundle. Textures of smooth, silky, or worsted-like, as well as woolen and heavy chenille types, can be achieved. The air-jet texturing system utilizes pressurized air, or some other fluid, to rearrange the filament bundle and create loops and bows along the length of the yarn. In a typical process, a tension is placed on the elastomeric filament prior to being fed into the texturing system where the applied tension affects the stretch ability of the final fabric or glove. Additionally, the multi-filament yarn to be bulked is fed to a texturing nozzle at a greater rate than it is removed from the nozzle, which is known as overfeed. The tension and overfeed settings used in the air-jet texturing system are independent variables with respect to one another, such that a variety of tension levels may be used with a variety of overfeed settings. The pressurized fluid impacts the filament bundle, creating loops and entangling the filaments in a random manner. The fluid-jet pressure can be in the range of about 70–90 psi. Using a bulking process with this overfeed rate creates a commingled yarn having a higher weight per unit length, or denier, than the yarn that was fed to the texturing nozzle. It has been found that the increase in weight per unit length should be in the range of about 3% to about 25 wt %, with increases in the range of about 3%–10 wt % preferred. The loops and entanglements create a continuous filament yarn that can be made into fabrics having high stretch ability and sufficient cut resistance.

Typically, cut resistant yarns lack the requisite stretch properties and only have proper bulk and texture. However, integration of the continuous synthetic elastomeric filament(s) (4), most preferably spandex, provides the cut resistant yarn (5) of the present invention with the necessary stretch properties. In the above-described process the elastomeric filament(s) (4) is fed into the texturing nozzle under tension. Generally, the tension is in the range of about 5 grams to about 30 grams, however, a tension of about 12 grams is preferred.

Overfeed typically indicates the speed (meters/minute) at which the filaments enter the fluid-jet, wherein the speed (meters/minute) at the entrance point is greater than the speed (meters/minute) at the exit point of the fluid-jet, such that loops are formed. Typically, the overfeed may be in the range of about 5% to about 30% per unit length of the yarn, however a range of about 5% to about 20% per unit length of the yarn is preferred.

Generally, the gloves (1) produced in accordance with the present invention can be made by conventional processes using equipment such as Sheima Seiki 13 gauge glove knitting machine. Further, a glove (1) of the present invention may be knitted or woven and may be produced by any conventional method for making gloves that is well known to those skilled within the art. The gloves (1) of the present invention, prior to being coated, are capable of being worn on either hand, thereby providing cut resistance and high stretchability without the limitation of selective use on a particular hand.

One method of making a glove (1) of the present invention includes the steps of:

a.) knitting or weaving a glove from a cut resistant yarn having strength and recovery capabilities comprising at least one continuous synthetic elastomeric filament and a plurality of bulked continuous cut resistant filaments;

b.) heat setting the elastomeric filament(s) of the glove;

c.) coating the glove; and d.) curing the coating disposed on the glove.

According to the present invention, heat setting of the glove (1) confers dimensional stability to the glove and is well known with the art. Generally, the glove (1) is placed into an oven for a specified duration of time, typically between about 0.2 to about 10 minutes, which may vary depending on the temperature of the oven and the types of filaments used in the glove (1). The oven temperature should remain at a temperature that is below the melting point for any filament used in the glove (1). While the duration of time and the temperature of the oven may be optimized for the particular components that comprise the glove (1), the preferred temperature for a knitted spandex fabric is about 175° C.

Curing, also well known within the art, typically acts as the mechanism by which the polymer coating is set in or on the glove (1), wherein the polymer is solidified. Further, curing serves to increase the polymer crosslinking and the coating's adhesion to the glove (1). The curing time ranges from about 5 to about 30 minutes and the curing temperature varies according to the curing time.

The embodiments of the present invention are further defined in the following Example. It should be understood that this Example, while indicating a preferred embodiment of the present invention, is given by way of illustration only. From the above discussion and this Example, one skilled in the art can ascertain the essential characteristics of this invention, and without departing from the spirit and scope thereof, can make various changes and modifications of the invention to adapt it to various uses and conditions. Thus various modifications of the present invention in addition to those shown and described herein will be apparent to those skilled in the art from the foregoing description. Although the invention has been described with reference to materials and embodiments, it is to be understood that the invention is not limited to the particulars disclosed, and extends to all equivalents within the scope of the claims.

EXAMPLES

Example 1

A Cut Resistant Yarn and Glove of Aramid Filaments and Spandex Filaments

Three yarns of high elasticity and recovery were formed by simultaneously overfeeding a continuous multifilament 400 denier (440 dtex) yarn containing 1.5 denier per filament (1.7 dtex) para(phenylene-terephthalamide) filaments and a single 140 denier spandex filament to a Taslan® air-jet texturing system. Tension was applied to the spandex prior to being fed into the texturing system. The air-jet texturing system provides independent adjustment of overfeed and tension, allowing a variety of simultaneous tension levels and overfeed settings. In all cases, the air-jet pressure was 90 psi.

The first yarn was made with an overfeed of about 30% per unit length of the yarn and a tension on the spandex of about 10 grams, a second yarn was made with an overfeed of about 14% per unit length of the yarn with the same tension on the spandex, and a third yarn was made with an overfeed of 14% per unit length of the yarn and a tension on the spandex of about 20 grams. A comparison of the yarns revealed that the 30% overfeed yarn was bulkier than the 14% overfeed yarns, as would be expected, and that air-jet pressure had no significant negative effect on the quality of the yarns in this range of overfeed. All yarns had a good balance of stretch and recovery properties. However, it was thought the increased bulk of the 30% overfeed yarn, when made into a glove, would probably allow more penetration of a coating into the glove fabric, providing a thicker, coating and a stiffer glove.

Glove samples having a fabric weight of 10 oz/yd$^2$ (about 0.34 kg/m$^2$) were knitted from the two 14% overfeed yarns using a standard Sheima Seiki 13 gauge glove knitting machine. The glove samples were divided into four sets and were heat set at a temperature of 175° C. (350° F.) for 0.5, 1.0, 1.5 and 2.0 minutes to set the glove form. It was found that optimum glove form setting was achieved when the gloves were heat set between 0.5 and 1.5 minutes. All glove samples exhibited good form fitting properties and flexibility, however, it was observed that the glove samples made with the 14% overfeed yarn and 10 grams of tension on the spandex provided a smoother glove. The glove samples were then sheathed onto a hand form and dipped into a polyurethane bath of an anionic aliphatic polyester polyurethane dispersion to coat the glove. The coated glove was then cured in an oven at about 135° C. for about 15 minutes. The resultant coated gloves were comfortable, fit well, and had a high degree flexibility.

What is claimed is:

1. A process of making a cut resistant yarn comprising at least one continuous synthetic elastomeric filament and a plurality of bulked continuous cut resistant filaments, wherein the plurality of bulked continuous cut resistant filaments have a random entangled loop structure in the yarn comprising the steps of:

(a) combining at least one continuous synthetic elastomeric filament under tension and a plurality of continuous cut resistant filaments to form a commingled yarn where the elastomeric filament is under tension (b) overfeeding the commingled yarn to a fluid-jet at a rate of no more than 30% per unit length of the yarn; and (c) bulking the plurality of continuous cut resistant filaments in the commingled yarn with a fluid to create a random entangled loop structure in the yarn.

2. The process according to claim 1, wherein the overfeed is about 5% to about 20% per unit length of the yarn.

3. The process according to claim 1, wherein the tension is about 5 to about 30 grams.

* * * * *